US005083618A

United States Patent [19]

Hayes

[11] Patent Number: 5,083,618

[45] Date of Patent: Jan. 28, 1992

[54] BUSH FIRE PROTECTION OF BUILDINGS

[76] Inventor: Gary D. Hayes, 92 Cricklewood Road, Heathfield, SA 5153, Australia

[21] Appl. No.: 586,896

[22] Filed: Sep. 24, 1990

[51] Int. Cl.[5] ..... A62C 35/58; A62C 35/68; A62C 3/00

[52] U.S. Cl. ..... 169/54; 169/16; 169/70

[58] Field of Search ..... 169/5, 16, 48, 54, 45, 169/70; 239/208, 209, 565, 568, 279, 597

[56] References Cited

U.S. PATENT DOCUMENTS

| | | | |
|---|---|---|---|
| 647,875 | 4/1900 | Piepenbrink | 169/16 |
| 1,208,349 | 12/1916 | Moody | 169/16 |
| 1,285,236 | 11/1918 | Kohler | 169/16 X |
| 1,599,411 | 9/1926 | Gilsenan | 169/16 X |
| 1,620,142 | 3/1927 | Thompson | 169/16 X |
| 1,936,732 | 11/1933 | Renard | 169/16 X |
| 2,865,674 | 12/1958 | Jelmeland | 169/5 X |
| 4,091,876 | 5/1978 | Valdatta | 169/16 X |
| 4,330,040 | 5/1982 | Ence et al. | 169/16 X |
| 4,836,290 | 6/1989 | LeLande, Jr. | 169/54 X |
| 4,991,657 | 2/1991 | LeLande, Jr. | 169/54 X |

FOREIGN PATENT DOCUMENTS

| | | | |
|---|---|---|---|
| 3202467 | 8/1983 | Fed. Rep. of Germany | 169/16 |
| 202625 | 9/1983 | Fed. Rep. of Germany | 169/16 |
| 2258201 | 8/1975 | France . | |
| 3606 | of 1812 | United Kingdom | 169/5 |

*Primary Examiner*—Johnny D. Cherry
*Assistant Examiner*—James M. Kannofsky
*Attorney, Agent, or Firm*—Lyon & Delevie

[57] ABSTRACT

A fire control system for buildings, wherein the building is provided with a sprinkler system around the perimeter of the building. The sprinkler system sprays water inwardly against the walls, windows and doors of the building.

8 Claims, 3 Drawing Sheets

BUSH FIRE PROTECTION OF BUILDINGS

BACKGROUND OF THE INVENTION

Severe bush fires usually occur when there is a high temperature and also a very strong wind. Due to the bush fire itself the wind velocity is often increased and this blows the extremely hot air in front of the fire face to such an extent that even though there may be a clear area around the building, the extreme heat would often cause the walls, window frames and the like to begin burning, this usually beginning by the paint being ignited by the intense heat. Also the extreme heat can cause the glass in the windows to fracture thus allowing the hot air, sparks and flying debris to enter the building to cause combustion from the inside of the building.

Various systems have been devised for protecting a building, and one of these has included the installation of rotary water sprinklers around the edge of the building and over the roof of the building. While these sprinklers do deliver a large quantity of water, this is sprayed upwardly and outwardly in all directions and while it may have a cooling effect on the air around the building, due to the fact that in circumstances of high bush fire danger, the strong winds usually prevalent at these times rapidly disperse and blow away the water issuing from these sprinklers thus negating the desired effect.

DESCRIPTION OF THE PRIOR ART

In AU-A-40128/85 there is disclosed an installation for the protection of buildings in bush fire conditions, this including at least one water supply pipe surrounding the building, and spray nozzles directing a sheet like spray of water downwardly around the outside of the building, and further jets directing a sheet like spray of water over the roof of the building.

Also FR2258201 allows sprinkling of water evenly over the entire surface of the roof and walls.

BRIEF STATEMENT OF THE INVENTION

There is provided according to the invention an installation for the protection of buildings in bush fire conditions, the installation including a water storage, a water supply pipe extending around the perimeter of the building, pump means to supply the pipe with water from the water storage, and sprinkler means positioned exteriorily of and spaced from the outer surface of the building to direct sprays of water in sheet form inwardly to spray the water against the outer surface of the building and upwardly over the roof of the building.

DESCRIPTION OF THE PREFERRED EMBODIMENT

Figure 1:
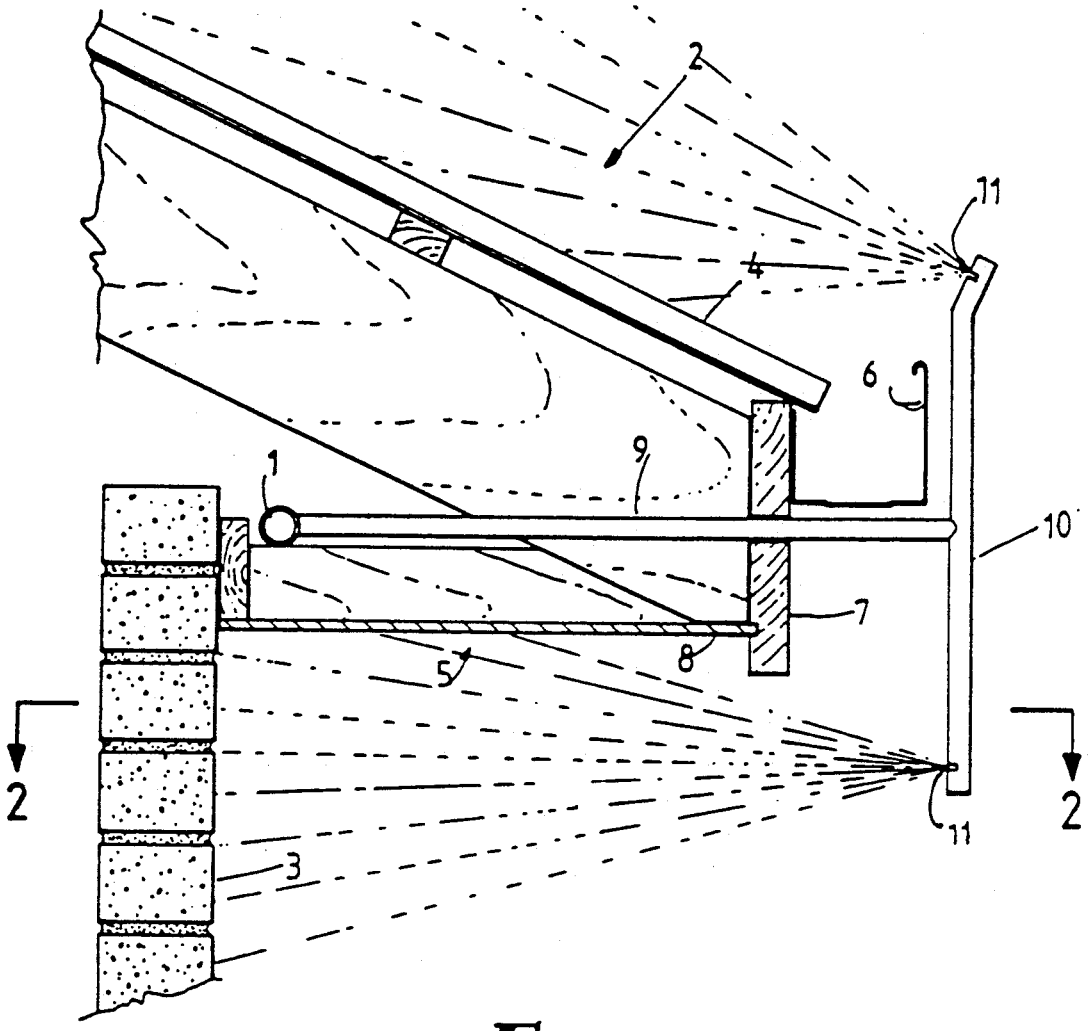
FIG. 1 is a partial elevation of a portion of a building with one form of installation.

In a preferred form of the invention, the installation can comprise a water supply pipe 1 extending around the perimeter of the building 2 having a wall 3 and a roof 4. The roof 4 extends beyond the wall 3 to form an eaves 5 with the gutter 6 attached to the facia board 7. The under surface of the eaves is closed by a board 8.

The water supply pipe 1 in this embodiment is positioned under the eaves 5 above the board 8, and thus in this embodiment can be installed when the building is erected. At intervals of say 2 or 3 metes there are provided branch pipes 9 extending from the supply pipe 1 to the spray pipes 10 which extend vertically. Each spray pipe can be a copper pipe having its ends closed and adjacent its ends is provided with spraying aperture such as a slit 11, which can be formed by a simple saw cut. The spray pipe toward its upper end can be bent so as to extend generally at right angles to the plane of the surface of the roof so that the spraying aperture directs the spray of water generally parallel to the surface of the roof. The ends of the spray pipes can be closed by a plug of copper, brass or other suitable material brazed, welded or otherwise sealed to the end of the spray pipe.

Figure 2:
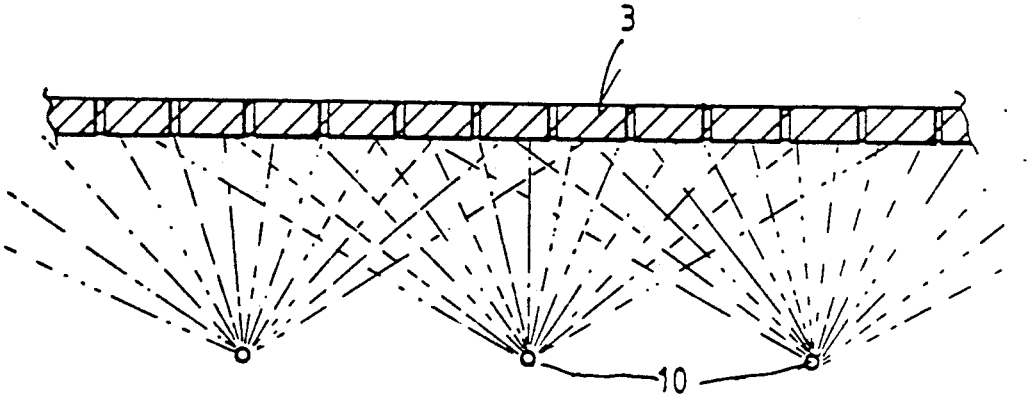
FIG. 2 is a view along the lines 2—2 of FIG. 1.

As shown in FIG. 2 the spray pipes 10 are spaced along the outer perimeter of the building such that the water sprays issuing therefrom overlap to a certain extent to ensure that the entire surface of the wall is covered by water running down over the wall.

Figure 3:
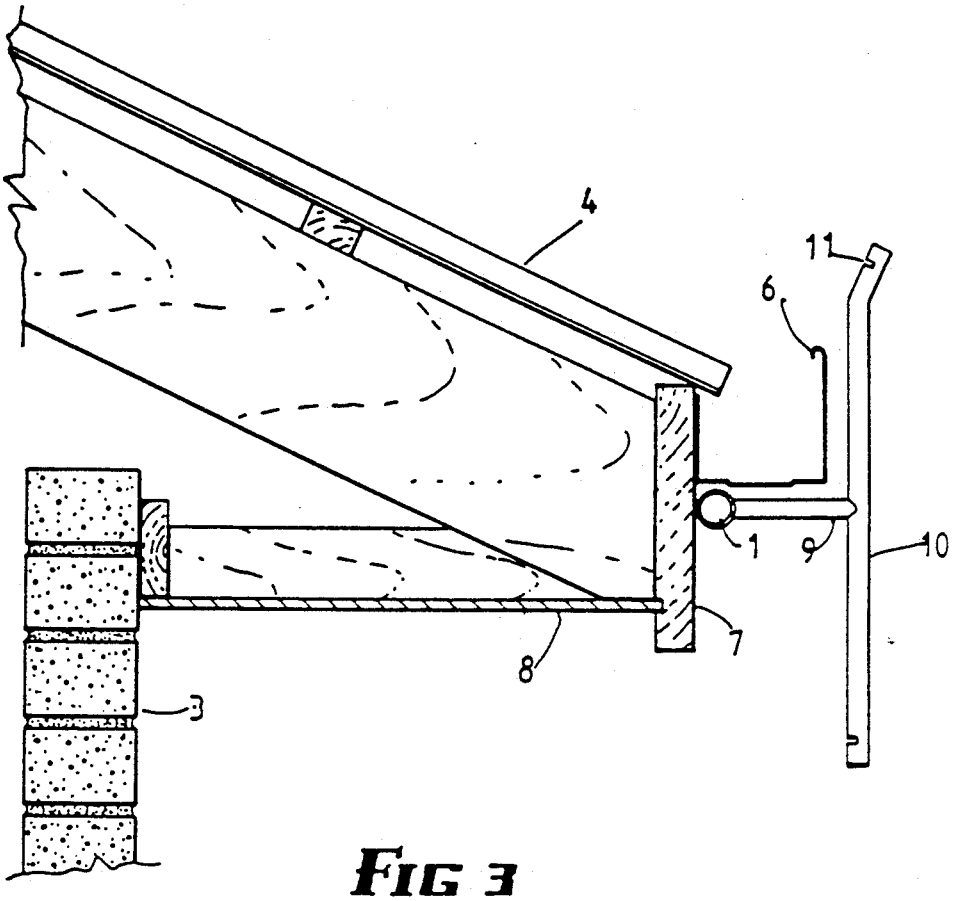
FIG. 3 is a view similar to FIG. 1 of a further form of the invention.

In FIG. 3 the installation can be fitted to an existing building and in this instance the supply pipe 1 is attached to the facia board 7 underneath the gutter 6, the branch pipe 9 being of correspondingly shorter length.

Figure 4:
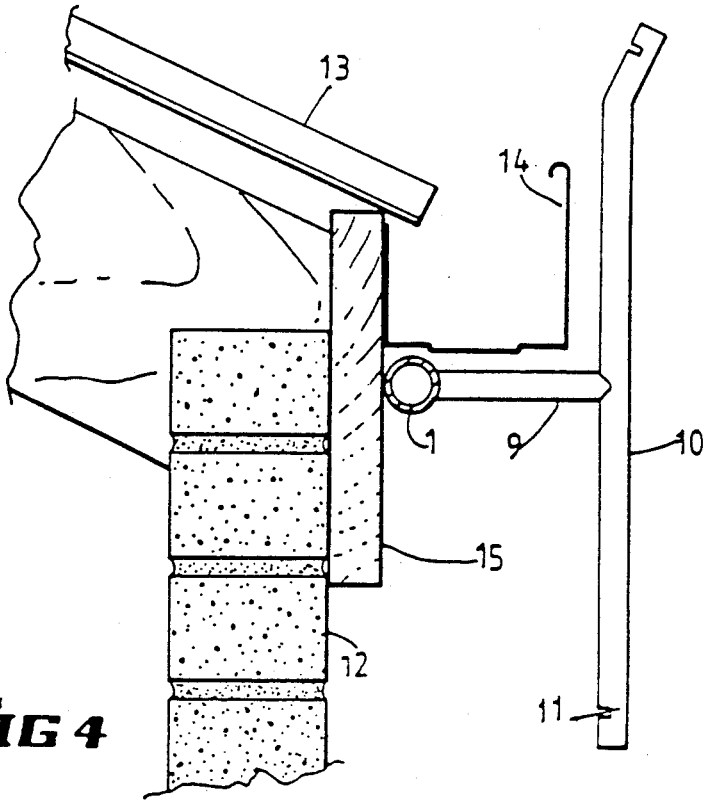
FIG. 4 is a view of a still further form of the invention.

FIG. 4 shows a similar installation for a building which does not have eaves, for example a shed or garage having a wall 12, roof 13 and gutter 14. In this instance the supply pipe 1 is attached to the facia board 15 directly below the gutter 14 with the branch pipe 9 being of a length to position the spray pipe 10 just outside the line of the gutter 14.

Figure 5:
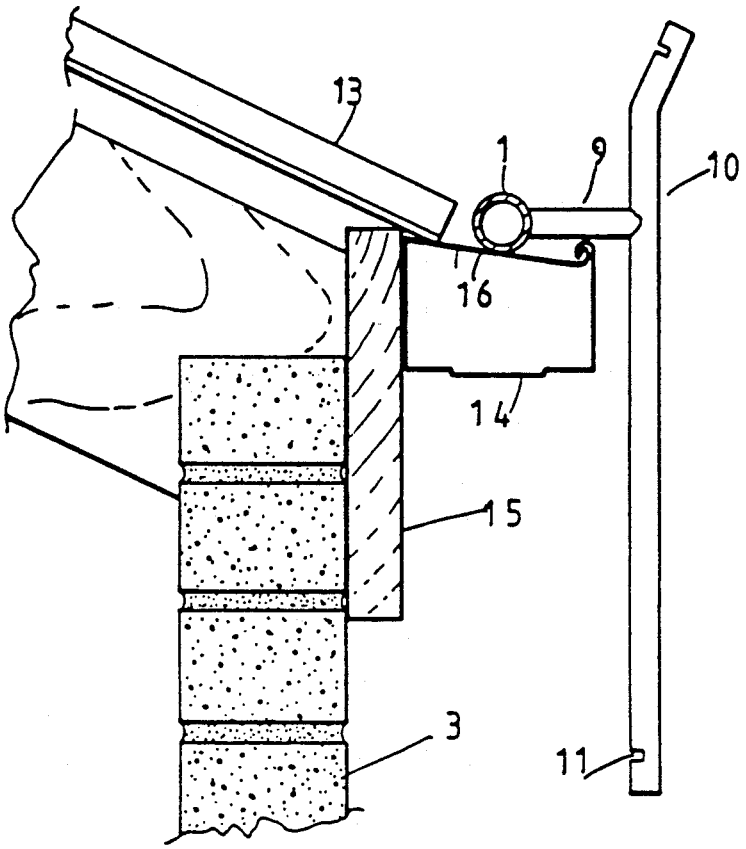
FIG. 5 is another form of the invention.

With reference to FIG. 5, this is similar to FIG. 4 with the water supply pipe 1 positioned above the gutter, for example on a leaf guard 16.

Figure 6:
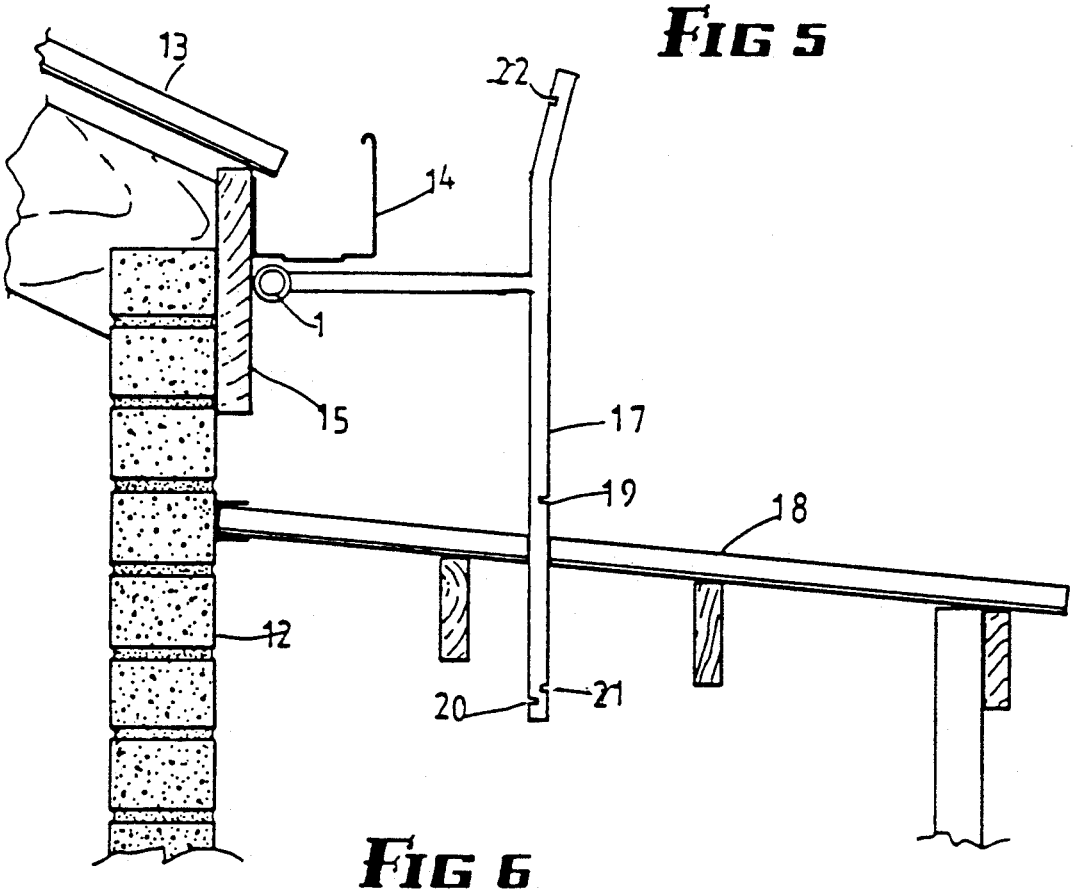
FIG. 6 shows the invention applied to a verandah or the like structure.

Turning now to FIG. 6 there is shown how the invention is adapted to protect a verandah, carport, pergola or other structure on a building. The water supply pipe 1 is positioned below the gutter 14 and is provided with a spray pipe 17 to extend downwardly through the roof 18 of the structure. The spray pipe 17 is provided with spraying apertures 19, 20 and 21, the aperture spraying water along the upper surface of the roof 18, the aperture 20 spraying water back against the wall 12 of the main building, one aperture spraying water along the underside of the roof of the structure, also pipe 17 extends upwardly having aperture 22 to spray water up over the roof of the building.

Thus it will be seen that according to the invention the outer surfaces of a building are protected. By the water running down the walls of the building the outer surface thereof is cooled and protected. Also this water would run over the windows keeping these cool so that they would not shatter from the heat.

As shown the water is also sprayed onto the roof. In order to ensure that the roof area is covered by the sprays of water, a supply pipe can run up the roof, either above or under the roofing material so that sprinklers can be positioned on the roof, along a ridge to ensure that all areas are covered. These ridge sprinklers can be staggered with respect to the ones on the eaves or gutters to ensure adequate coverage and overlap.

The water supply can be from a tank or other water storage unit, preferably one in which the water is collected from the run off from the roof of the building. Thus the water which is sprayed onto the roof of the building is collected and thus is saved and can be reused, suitable filters being provided prior to entry into the tank to collect ash and other flying debris. Additional filters may be provided if desired between the tank and the pump. As the electrical supply would not be reliable in a bush fire situation, the pump would preferably be driven by an internal combustion engine.

The water supply pipe can be a copper pipe and the branch pipes also of copper which are welded or brazed to the water supply pipe. Thus the spray pipes are also welded or brazed to the branch pipes, and the spray pipes can be bent as desired so that the water is directed as desired. The spray apertures can be simple saw cuts and, the size of cut can be used to achieve the desired water output. By increasing the size of the slot the water output can be increased. Also the water supply can be increased by increasing the size of the water supply pipes, feed pipes and pump/motor combination.

Thus there is provided around the perimeter of the building a continuous supply of water flowing down the walls of the building. It will be seen that even on the side of the building facing the oncoming fire, that the flow of water will protect that side of the building and the wind would assist in the sprays directing the water onto the walls of the building and the windows and doors, thus keeping these virtually saturated and cool.

By having the spray nozzles positioned outside the perimeter of the building the spray of water by being directed back onto the walls of the building, the spray of water is protecting the underside of the eaves, this spray preventing the heat and any flying debris from igniting this area of the eaves. The spray nozzles spraying the water over the roof will cause the guttering to be flooded with water thus preventing any leaves and other debris in the guttering from igniting.

The spray nozzles of the invention are simple to produce, and have no moving or working parts. Thus maintenance is at a minimum. The outlet from the pump may have a branch with two outlets, each controlled by a valve, one being a return to the pump and the other to the sprinkler system. To test the pump and run the motor occasionally, the spray may recirculate the water through to tank without having to waste water through the sprinklers.

Also during a heat wave the building can be cooled by operating the system for a few minutes, whereby the temperature of the interior can be quickly be lowered.

The pump and motor would desirably be positioned and sited so that they would be protected from the bushfire irrespective of the direction from which the bushfire approaches the building.

The invention can be applied, not only to single storied buildings, but also multi-storied buildings, flats, factories and the like, also it can be used on marine craft, ships and the like where the pump may draw water from the ocean, lake etc. Also in a further embodiment, the tank can be connected to the mainsreticulated supply by a float valve, so that even during periods of draught the tank is left full of water. Furthermore additional sprinklers can be provided in the ground around the house to spray water over and saturate the ground and vegetation before the fire reaches the property, as the sprinklers spray the water parallel to the ground and not into the air, greater saturation with less evapration is achieved. Common garden and irrigation sprinklers spray the water into the air causing great losses by evaporation in these circumstances.

Also it will be appreciated that the motor and pump would be operated before the bush fire reaches the building so that the building is cooled and wet before the fire reaches the building. In severe bush fires flying burning debris often precedes the main fire front, and it is known that eucalyptus trees will spontaneously ignite well in advance of the main fire front.

In order to ensure that the pump and motor operate in advance of the fire when there is nobody on the premises to start the motor, the motor could be activated by a telephone call to a specific number the telephone received activating a control member which would then start the motor. Alternatively the motor may be started by the receipt of a special radio signal which may be from a radio station or private radio transmitter, CB radio or the like.

Thus it will be seen that there is provided according to the invention a system and installation for the protection of buildings in a bush fire situation, and although various alternatives have been described the invention is not to be limited thereto, but can include variations and modifications falling within the spirit and scope of the invention.

I claim:

1. In an installation for the protection of the roof and exterior walls of a building in bush fire conditions comprising a water storage, a water supply pipe extending around and adjacent to the perimeter of the building, and pump means to supply the pipe with water from the water storage, the improvement comprising at least one branch pipe connected to said supply pipe and extending outwardly relative to the building beyond the perimeter thereof, and a vertical sprinkler pipe connected to an outer end of said branch pipe so as to be horizontally spaced from said supply pipe, said sprinkler pipe having first sprinkler means at an upper end thereof and disposed above the roof of said building for directing a spray of water over said roof and second sprinkler means at a lower end thereof and disposed below the roof of said building for directing a spray of water inwardly toward the building against the exterior wall and below the roof thereof.

2. An installation as defined in claim 1 wherein said water supply pipe is disposed adjacent to the junction of the exterior wall and the roof of said building, whereby said second sprinkler means directs a spray of water back onto the walls directly underneath said junction.

3. An installation as defined in claim 2 wherein said vertical sprinkler pipe is attached to the branch pipe intermediate the length of the vertical sprinkler pipe, said sprinkler pipe being closed at its ends and provided with narrow horizontal slits adjacent the closed ends thereof through which the water issues, the upper slit directing a spray of water over the roof and the lower slit directing a spray inwardly against the wall of the building.

4. An installation as defined in claim 3 wherein the pipes are copper pipes welded or brazed to each other, and the narrow slits are saw cuts.

5. An installation as defined in any one of the preceding claims wherein the supply pipe extends around the building in the eaves of the building with additional sprinklers on a ridge of the roof.

6. An installation as defined in any one of claims 1 to 3 wherein the supply pipe extends around the building directly beneath the eaves of the building.

7. An installation as defined in any one of claims 1 to 3 wherein the supply pipe extends around the building directly against the wall beneath the gutter.

8. An installation as defined in any one of claims 1 to 3 wherein there are additional sprinklers along a ridge of the roof.

* * * * *